United States Patent [19]

Blankenship

[11] Patent Number: 4,858,384

[45] Date of Patent: Aug. 22, 1989

[54] DOOR JAMB REINFORCEMENT PLATE

[75] Inventor: James E. Blankenship, Fayetteville, N.C.

[73] Assignee: Carolina Masters, Inc., Fayetteville, N.C.

[21] Appl. No.: 194,428

[22] Filed: May 13, 1988

[51] Int. Cl.[4] ..... E06B 1/04

[52] U.S. Cl. ..... 49/460; 49/504; 52/514

[58] Field of Search ..... 49/460, 462, 504, 503; 292/346, 341.9; 52/514

[56] References Cited

U.S. PATENT DOCUMENTS

| | | | |
|---|---|---|---|
| 306,806 | 10/1884 | Barnes | 49/462 |
| 1,238,924 | 9/1917 | Kennedy | 292/341.19 |
| 3,963,269 | 6/1976 | Rosenberg | 292/346 |
| 4,074,484 | 2/1978 | Queren | 52/214 |
| 4,416,087 | 11/1983 | Ghatak | 49/462 |
| 4,631,866 | 12/1986 | Otto et al. | 49/504 |
| 4,635,399 | 1/1987 | Gehrke et al. | 49/460 |
| 4,673,204 | 6/1987 | Allenbaugh | 292/346 |
| 4,690,445 | 9/1987 | Hartley | 292/346 X |
| 4,717,185 | 1/1988 | Hartley | 292/346 X |

*Primary Examiner*—Philip C. Kannan

*Attorney, Agent, or Firm*—Richard E. Jenkins

[57] ABSTRACT

A door jamp reinforcement plate includes an elongate support plate having an L-shaped cross section with a first side to overlap the inside of a door jamb and a second side to overlap the front of a door jamb, and a plurality of vertically arrayed punch-out tabs located along a length of the first side that may be selectively punched out to facilitate alignment with the striker or bolt of each door lock. The vertically arrayed punch-out tabs allow the door jamb reinforcement plate to be universally adaptable to any door frame with only simple adjustment with conventional home tools.

10 Claims, 3 Drawing Sheets

DOOR JAMB REINFORCEMENT PLATE

TECHNICAL FIELD

The present invention relates generally to door frames, and more particularly to a reinforcement plate for a door jamb that can be easily adapted to accommodate any door lock or combination of door locks which may be found on a door.

BACKGROUND ART

As is well known to those in law enforcement, a quick and easy way for criminals to gain access to a locked home is to kick a front or rear door so hard that the door lock splits the wood of the door jamb and allows entry to the formerly locked home. Not only does this type of forced entry result in the loss of valuable property but it also results in physical damage to the home or dwelling which must be repaired at substantial cost.

Prior efforts have been made to provide a security plate or door jamb support of the type which is secured not only to the door jamb, as is a conventional strike plate, but also to the underlying stud. This type of security plate typically extends for substantially the entire height of the door jamb and has either one or two apertures therein to receive the bolt of the primary door lock and any additional deadbolt or other locks used to secure the door. However, these known security plates are not universally adaptable for use with substantially any door frame and door since the apertures provided therein to receive the lock bolts must typically be custom made or tailored to accommodate many of the configurations of door locks on doors.

Although numerous types of security devices have been developed to aid in preventing the forced entry problem described above, one such device is disclosed in U.S. Pat. No. 4,635,399 to Gehrke, et al. This patent discloses a door jamb support which, at first impression, is somewhat similar to the present invention. However, the reinforcement plate described therein provides only for an adjustment mechanism whereby a strike plate positioned over the reinforcement plate may be adjusted laterally in order to accommodate variances in the design of and in the position of door handle latches in doors. This type of reinforcement plate or jamb support does not provide for any capability to accommodate the vertical variances in the position of the bolts of door locks and accompanying deadbolt locks and the like which may be used therewith. Therefore, a device such as disclosed in Gehrke, et al. is not universally adaptable to all doors and frames and thus many times will have to be custom made in order to accommodate a particular door and door lock configuration. The door jamb support disclosed in Gehrke, et al. serves only to highlight the shortcomings of previously known door jamb supports and the advancement of the applicant's invention thereover.

DISCLOSURE OF THE INVENTION

In accordance with the present invention applicant provides a door jamb reinforcement plate designed specifically to be universally adaptable for use with substantially any door jamb, door and door lock configuration without the necessity for a custom made door jamb reinforcement plate in order to fit it to the user's door and door locks.

The door jamb reinforcement plate of the present invention comprises an elongate support plate having an L-shaped cross section adapted to have a first side thereof overlap at least a portion of the door jamb defining the inside of a door frame and the second side thereof overlap at least a portion of the door jamb defining the face of a door frame, and a plurality of vertically arrayed punch-out tabs positioned along a portion of the first side of the support plate so that the support plate may be mounted on substantially any door jamb with one of the punch-out tabs in alignment with the striker or bolt of each of the one or more door locks on the accompanying door. Then the aligned tab or tabs may be punched out and the support plate mounted to the door jamb by suitable securement means. Most suitably, the vertically arrayed punch-out tabs comprise about 16 scored and vertically spaced-apart sections of the support plate which may be selectively punched out to accommodate one or more bolts of one or more door locks on a door mounted in a door frame of which the door jamb is a part.

It is therefore the object of the present invention to provide an improved door jamb support which is universally adaptable to accommodate any door lock or configuration of door locks provided in a door.

Another object of the present invention is to provide a universal door jamb reinforcement plate which may be easily fitted to a particular door frame assembly with only ordinary household tools.

Some of the objects of the invention having been stated, other objects will become evident as the description proceeds, when taken in connection with the accompanying drawings.

BEST MODE FOR CARRYING OUT THE INVENTION

Figure 1:
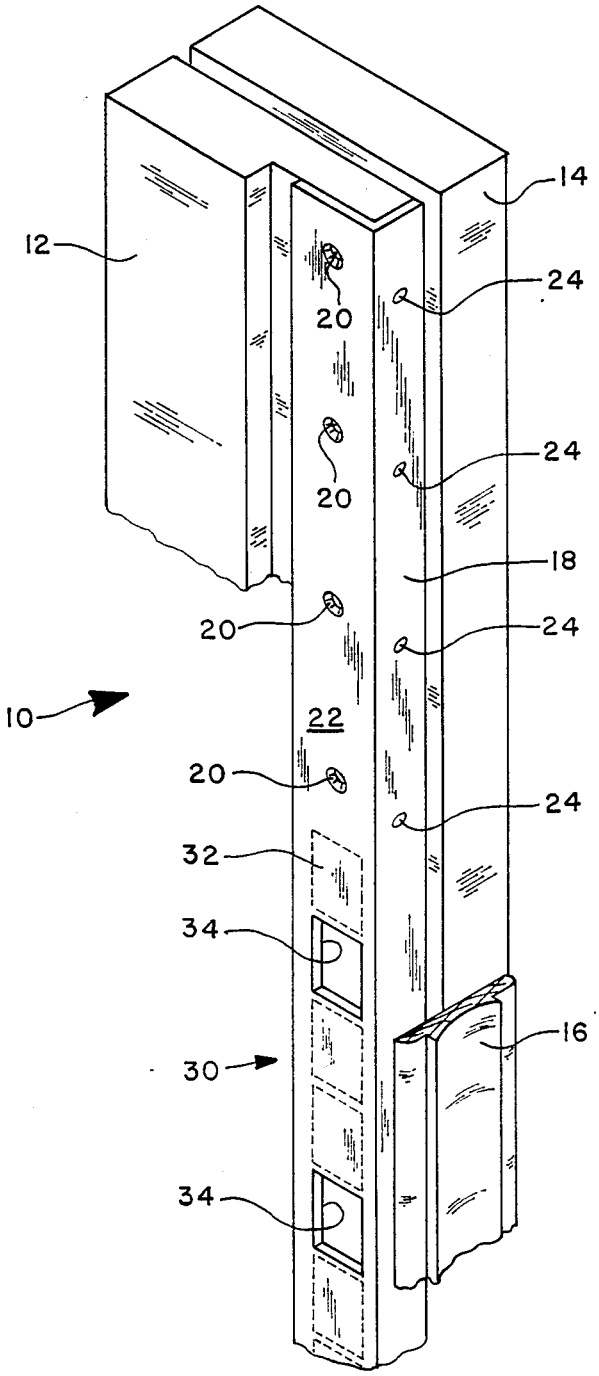
FIG. 1 is a fragmentary perspective view, partially in section, illustrating a door jamb incorporating a door jamb reinforcement plate constructed according to the present invention.

Referring now to the drawings, FIG. 1 illustrates a door frame incorporating a door jamb reinforcement plate constructed in accordance with the present invention and generally designated 10. The door frame shown in FIG. 1 includes a door jamb 12 and a wall stud 14 therebehind to which door jamb 12 is normally nailed. The door frame would also normally include a strip of door casing 16 to cover the outer side 18 of reinforcement plate 10. Door jamb reinforcement plate 10 is secured to door jamb 12 and wall stud 14 with wood screws (not shown) which extend through apertures 20 provided in the inner side 22 of reinforcement plate 10. The wood screws are most suitably 3 inch screws which extend through aperture 20 of reinforcement plate 10, door jamb 12 and into wall stud 14 so as to render the door jamb greatly reinforced against splitting or damage caused by forced entry through kicking or prying a locked door. Reinforcement plate 10 also includes apertures 24 provided in outer side 18 of the reinforcement plate through which nails (not shown) are most suitably driven in order to secure door casing 16 to door jamb 12. As can be seen with reference to the drawings, apertures 20 in inner side 22 and apertures 24 in outer side 18 are slightly offset to facilitate installation of reinforcement plate 10 to door jamb 12.

Figure 2A:
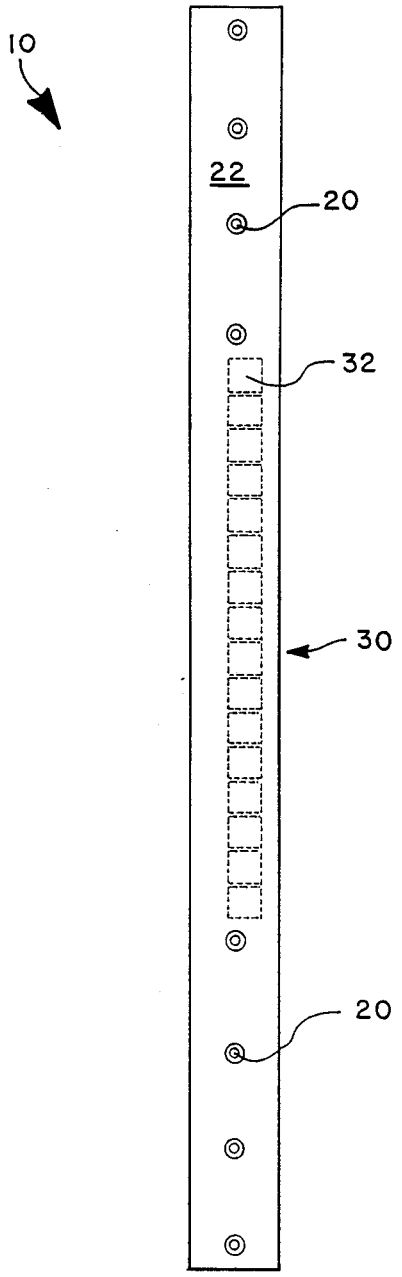
FIG. 2A is a side elevation view of the door jamb reinforcement plate of the present invention.
Figure 2B:
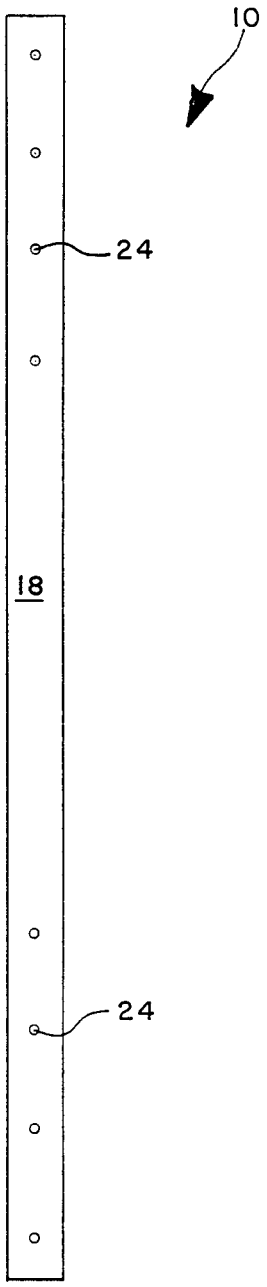
FIG. 2B is a front elevation view of the door jamb reinforcement plate of the present invention.
Figure 3A:
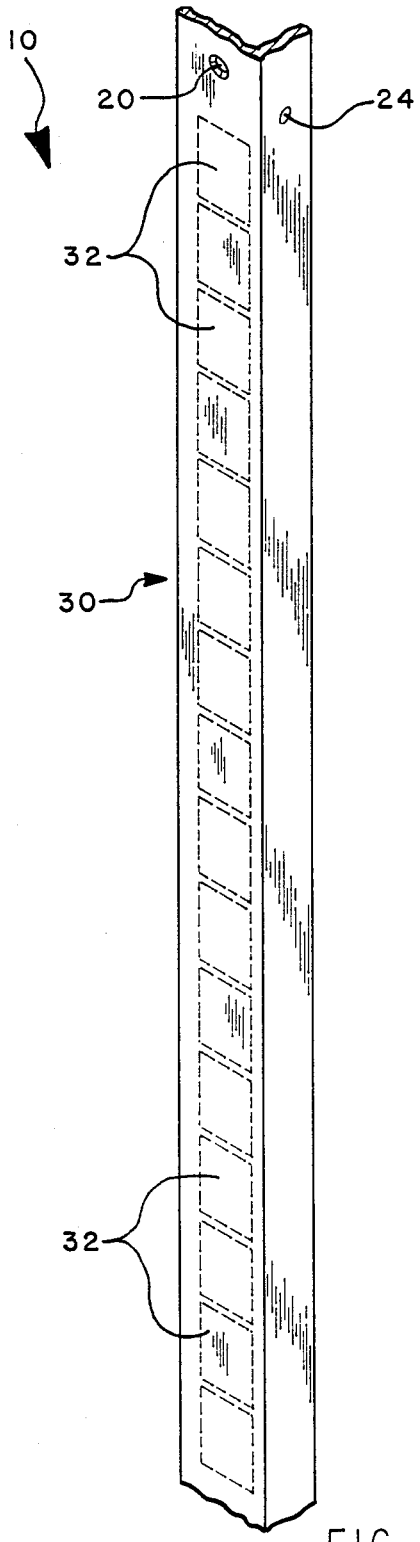
FIG. 3A is a fragmentary perspective view illustrating the vertical array of punch-out tabs of the door jamb reinforcement plate of the present invention.
Figure 3B:
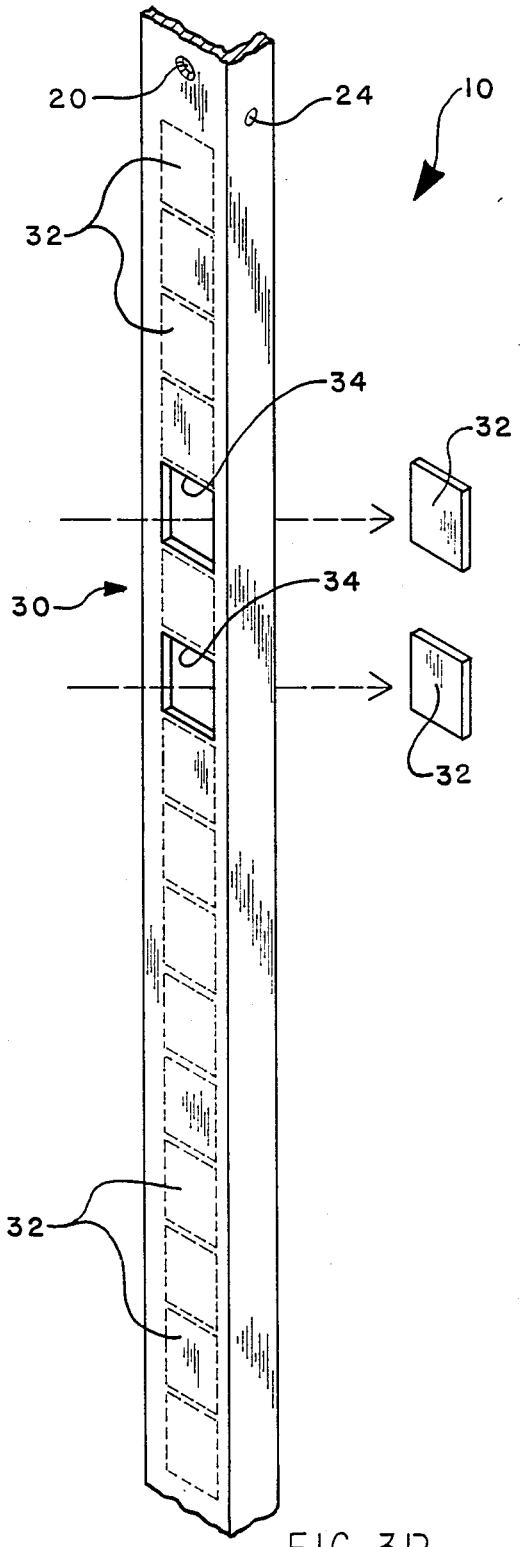
FIG. 3B is a fragmentary perspective view illustrating the vertical array of punch-out tabs as shown in FIG. 3A with two tabs removed to accommodate the bolts of a conventional door lock and associated deadbolt lock.

With reference now to FIGS. 1–3, it can be seen that reinforcement plate 10 includes a section of scored punch-out tabs, generally designated 30, along the medial portion of inner side 22. Although a matter of design choice, the preferred embodiment of the present invention contemplates providing 16 individually scored punch-out tabs 32 in reinforcement plate 10.

Reinforcement plate 10 is preferable formed of 16 gauge stainless steel and is 84 inches in length with a 1 inch wide outer side 18 and a 1¾ inch wide inner side 22. Scored punch-out tabs 32 most preferably are each ¾ inches in width and 1 inch in height with a ⅛ inch space or strip therebetween. It is also contemplated that reinforcement plate 10 may be constructed without the strips or spaces between punch-out tabs 32. Also, it should be appreciated that although 16 punch-out tabs 32 are depicted in the preferred embodiment illustrated in the drawings, it is believed that from 5 to 25 punch-out tabs 32 extending from about 5 to 25 inches would provide the universal mounting capability of the present invention. Furthermore, although an 84 inch length is preferred for reinforcement plate 10 since this is the height of a conventional door frame, reinforcement plate 10 could be made with any substantial length including, most preferably, between about 60 to 84 inches so as to extend along the majority of the height of a door frame.

Applicant's door jamb reinforcement plate 10 is universally adaptable to fit all door frames due to the plurality of scored punch-out tabs 32 in the medial portion thereof. Normally, reinforcement plate 10 will have two punch-out tabs 32 which will be knocked out by conventional means such as a screw driver and hammer or nail and hammer in order to accommodate the bolt of the primary door lock as well as the bolt of an associated deadbolt or other secondary door lock. This can be seen in FIG. 3B wherein two punch-out tabs 32 have been removed so as to leave two apertures 34 for receiving the aforesaid bolts. It should be understood that these two particular punch-out tabs 32 have been removed in order to accommodate the bolts on a particular door but that another door may require different punch-out tabs 32 to be removed in order to provide apertures 34 in proper alignment with the bolts of the door locks associated with the other door and the openings (not shown) formed in the face of door jamb 12 for receiving the bolts. In this fashion, applicant's door jamb reinforcement plate 10 is universally adaptable to substantially any door frame and door with only a simple adjustment procedure which can be performed with conventional home tools.

INSTALLATION PROCEDURE

For a still better understanding of the invention, applicant wishes to set forth below the basic installation steps for the novel door jamb reinforcement plate:

Step 1: Remove the door lock and deadbolt striker plates as well as the door casing from the lock side of the door.

Step 2: Using a saber saw or the like, remove ⅛ inch of the door jamb edge from the top to the bottom in order to facilitate flush placement of the door jamb reinforcement plate. This is an optional step in the installation of applicant's inventive reinforcement plate to assure a snug fit with the door jamb.

Step 3: Align the door lock and deadbolt striker or bolt holes with appropriate punch-out tabs and, using a hammer and screw driver or hammer and nail, punch-out the necessary punch-out tabs for the bolts of the door lock and the deadbolt.

Step 4: Place the door jamb reinforcement plate tightly against the door jamb and, using a drill with a ⅛ inch bit, drill through the screw apertures to form pilot holes 2½ inches deep. Place wood screws in the holes and insert them carefully to assure that they are screwed down flush with the door jamb reinforcement plate.

Step 5: Close the door to check the door lock and deadbolt bolts and, if necessary, make minor adjustments with a file to assure that the bolts align with the apertures created by removal of the punch-out tabs.

Step 6: Place the door casing back in place and renail it so that the nails extend through the door casing and the apertures in the reinforcement plate therebeneath. Then, putty the holes and repaint the casing if it is necessary.

Thus it can be seen that applicant's door jamb reinforcement plate comprising an elongate support plate with vertically arrayed punch-out tabs is universally adaptable to any door frame. The vertical adjustability provided by the vertically arrayed punch-out tabs allows for universal use of the door jamb reinforcement plate of applicant's invention without the necessity for custom manufacture of reinforcement plates or time intensive alteration thereof to accommodate the strikers of the many possible lock configurations to be found in residential or business wood frame door assemblies. Also, although not contemplated as the preferred embodiment of the present invention, the conventional strike plates removed from a door jamb to install applicant's door jamb reinforcement plate may be secured over the reinforcement plate if it should be desired to do so.

It will be understood that various details of the invention may be changed without departing from the scope of the invention. Furthermore, the foregoing description is for the purpose of illustration only, and not for the purpose of limitation—the invention being defined by the claims.

What is claimed is:

1. A door jamb reinforcement plate comprising:

an elongate support plate comprising an L-shaped cross section adapted to have a first side thereof overlap at least a portion of the door jamb defining the inside of a door frame and a second side thereof overlap at least a portion of the door jamb defining the front of a door frame; and a plurality of vertically arrayed punch-out tabs located along and provided integrally within a length of said first side of said support plate so that said support plate is universally mountable on a door jamb with one of said punch-out tabs in alignment with a striker of each of one or more door latches on a door;

whereby said aligned tab can be punched out and said support plate then suitably mounted to a door jamb for reinforcement thereof.

2. A door jamb plate according to claim 1 wherein said elongate support plate is about 60 to 84 inches in length.

3. A door jamb plate according to claim 1 wherein said support plate further includes a plurality of apertures in said first side for receiving screws and a plurality of apertures in said second side for receiving nails in order to facilitate securement of said support plate to a door jamb.

4. A door jamb plate according to claim 1 wherein said plurality of punch-out tabs comprise about 5 to 25 punch-out tabs extending along a length of about 5 to 25 inches.

5. A door jamb plate according to claim 4 wherein said plurality of punch-out tabs each comprise a scored section in said support plate which when punched out defines a generally rectangular aperture.

6. A door jamb plate according to claim 4 wherein said plurality of punch-out tabs are in spaced-apart relationship so as to define a strip therebetween.

7. A door jamb reinforcement plate comprising:

an elongate support plate about 60 to 84 inches in length and comprising an L-shaped cross section adapted to have a first side thereof overlap at least a portion of the door jamb defining the inside of a door frame and a second side thereof overlap at least a portion of the door jamb defining the front of a door frame; and a plurality of about 5 to 25 vertically arrayed punch-out tabs located along and provided integrally within about a 5 to 25 inch length of said first side of said support plate so that said support plate is universally mountable on a door jamb with one of said punch-out tabs in alignment with a striker of each of one or more door latches on a door;

whereby said aligned tab can be punched out and said support plate then suitably mounted to a door jamb for reinforcement thereof.

8. A door jamb plate according to claim 7 wherein said plurality of punch-out tabs each comprise a scored section in said support plate which when punched out defines a generally rectangular aperture about 1 inch high and 0.75 inches wide.

9. A door jamb plate according to claim 7 wherein said plurality of punch-out tabs are in spaced-apart relationship so as to define a strip therebetween about 0.125 inches high and about 0.75 inches wide.

10. A door jamb plate according to claim 7 wherein said support plate further includes a plurality of apertures in said first side for receiving screws and a plurality of apertures in said second side for receiving nails in order to facilitate securement of said support plate to a door jamb.

* * * * *